US012416111B1

(12) United States Patent
Wang

(10) Patent No.: US 12,416,111 B1
(45) Date of Patent: Sep. 16, 2025

(54) ARTIFICIAL TURF AND MAKING METHOD THEREOF

(71) Applicant: Kanlun Wang, Hangzhou (CN)

(72) Inventor: Kanlun Wang, Hangzhou (CN)

(73) Assignee: Hangzhou Aitebomi Technology Co., Ltd., Hangzhou (CN)

( * ) Notice: Subject to any disclaimer, the term of this patent is extended or adjusted under 35 U.S.C. 154(b) by 0 days.

(21) Appl. No.: 19/033,560

(22) Filed: Jan. 22, 2025

(51) Int. Cl.
*E01C 13/08* (2006.01)
*D05C 17/02* (2006.01)

(52) U.S. Cl.
CPC ..... *D05C 17/023* (2013.01); *E01C 13/08* (2013.01); *D10B 2321/021* (2013.01); *D10B 2403/0111* (2013.01); *D10B 2505/202* (2013.01)

(58) Field of Classification Search
None
See application file for complete search history.

(56) References Cited

U.S. PATENT DOCUMENTS

2007/0237921 A1* 10/2007 Knapp ..... D03D 27/00 428/17
2010/0092702 A1* 4/2010 Debaes ..... D06N 7/0065 428/17
2010/0129570 A1* 5/2010 Bearden ..... E01C 13/08 428/17
2014/0193593 A1* 7/2014 Daluise ..... E01C 13/08 428/17
2019/0360160 A1* 11/2019 Mashburn ..... A41G 1/009

* cited by examiner

*Primary Examiner* — Kim S. Horger

(57) ABSTRACT

An artificial turf includes a turf base and a grass yarn portion. The turf base is latticed. The grass yarn portion is connected to the turf base through thermoplastic adhesive powder. The grass yarn portion includes grass yarn tufts. Each grass yarn tuft includes a plurality of grass yarns. The grass yarns are prepared from a polyethylene through a KDK curved yarn process. By the arrangement of the above structure, during use, the lattice design of the turf base is conducive to water permeation, which enables water to quickly pass through the turf base, avoids water accumulation on a surface of the turf, and maintains a good use condition of the turf. Meanwhile, the latticed structure can provide a stable support for the grass yarn portion, ensuring that the grass yarns are not prone to lodging or displacement during long-term use.

9 Claims, 9 Drawing Sheets

ARTIFICIAL TURF AND MAKING METHOD THEREOF

TECHNICAL FIELD

The present invention relates to the technical field of artificial turfs, and in particular, to a high-water-permeability artificial turf for a pet and a making method thereof.

BACKGROUND OF THE INVENTION

With the improvement of the living standard, it is increasingly common to keep pets. In a pet activity space, an artificial turf is widely used as a convenient, clean, aesthetically pleasing, and practical laying material. However, there are many problems in existing artificial turfs for pets, among which, the prominent problem is low water permeability. Low water permeability makes it difficult for water in excrement of a pet to quickly permeate, which can easily cause water accumulation on a surface of the turf and breed bacteria. This not only affects the health of the pet, but also gives off an unpleasant odor, causing many troubles for pet owners.

With the improvement of the quality of life and the pursuit of high standards for a pet raising experience, there is a need for a new type of artificial turf that not only has the advantages of the traditional artificial turf, but also overcomes the disadvantages of the traditional artificial turf.

Therefore, the present invention provides an artificial turf that can effectively solve the above-mentioned problems.

SUMMARY OF THE INVENTION

To overcome the shortcomings in the prior art, the present invention provides an artificial turf which has a simple structure, can further solve the problems of low water permeability and the like of the traditional artificial turf, and effectively ensures a user experience, to further enhance the user experience of the artificial turf.

The technical solution adopted by the present invention to solve the technical problem is as follows.

An artificial turf includes a turf base and a grass yarn portion. The turf base is latticed. The grass yarn portion is connected to the turf base through thermoplastic adhesive powder. The grass yarn portion includes grass yarn tufts. Each grass yarn tuft includes a plurality of grass yarns. The grass yarns are prepared from a polyethylene through a KDK curved yarn process.

As an improvement of the present invention, the turf base includes a first base fabric and a second base fabric; each of the first base fabric and the second base fabric includes base fabric warps and base fabric wefts; and each of the first base fabric and the second base fabric is formed by vertically and horizontally weaving the base fabric warps and the base fabric wefts which are made of a thermoplastic resin material.

As an improvement of the present invention, the thermoplastic resin material is polypropylene.

As an improvement of the present invention, the grass yarns are arranged in a spacing manner along the base fabric warps and are continuously arranged along the base fabric wefts.

As an improvement of the present invention, the base fabric warps are flatly linear, and the base fabric warps include front surfaces of warp and back surfaces of warp; the base fabric wefts include first wefts and second wefts; and the first wefts and the second wefts alternately abut against the front surfaces of warp and the back surfaces of warp during weaving.

As an improvement of the present invention, a grid of the turf base is a polygon, and an edge length of the polygon is greater than 1 mm.

As an improvement of the present invention, a grid of the turf base is approximately a square, and an edge length of the square is about 3 mm.

As an improvement of the present invention, the thermoplastic adhesive powder is polyethylene adhesive powder.

As an improvement of the present invention, the grass yarns are woven on the turf base through a tufting process, and are then adhered to the turf base through a hot-melting process. As an improvement of the present invention, a water permeability at 200 ml/20 s of the artificial turf is 65% to 75%.

The present invention also provides a making method of an artificial turf, including:

S10: making grass yarns from a polyethylene material;

S20: making a latticed turf base;

S30: weaving the grass yarns on the turf base by using a tufting machine;

S40: adhering the grass yarns to the turf base through a hot-melting process; and

S50: performing trimming and quality inspection.

As an improvement of the present invention, step S10 includes:

S11: preparing a raw material;

S12: performing processing and molding; and

S13: performing KDK curved yarn treatment.

As an improvement of the present invention, step S13 includes:

S13*a*: preheating equipment;

S13*b*: conveying and locating the grass yarns;

S13*c*: performing hot air parameter setting and function; and

S13*d*: curved yarn molding and cooling.

As an improvement of the present invention, step S20 includes:

S21: preparing a raw material;

S22: processing and molding base fabric warps and base fabric wefts; and

S23: weaving the latticed turf base.

As an improvement of the present invention, step S23 includes:

S23*a*: pretreating the material;

S23*b*: preparing and debugging weaving equipment;

S23*c*: performing weaving and molding; and

S23*d*: performing quality monitoring and adjustment.

As an improvement of the present invention, step S30 includes:

S31: setting parameters of the tufting machine;

S32: performing a tufting operation; and

S33: performing quality monitoring and adjustment.

As an improvement of the present invention, step S31 includes:

S31*a*: adjusting a needle pitch and a number of threads;

S31*b*: setting a tufting height; and

S31*c*: adjusting a tufting angle.

As an improvement of the present invention, step S32 includes:

S32*a*: grabbing and planting the grass yarns; and

S32*b*: fixing the grass yarns.

As an improvement of the present invention, step S40 includes:

S41: preparing the material and the equipment;

S42: pretreating the turf base;

S43: scattering polyethylene adhesive powder on the turf base; and

S44: bonding and fixing the turf.

As an improvement of the present invention, step S44 includes:

S44*a*: placing and aligning the turf base; and

S44*b*: performing pressurization for fixing.

The present invention has the following beneficial effects. By the arrangement of the above structure, during use, the lattice design of the turf base is conducive to water permeation, which enables water to quickly pass through the turf base, avoids water accumulation on a surface of the turf, and maintains a good use condition of the turf. Meanwhile, the latticed structure can provide a stable support for the grass yarn portion, ensuring that the grass yarns are not prone to lodging or displacement during long-term use. In addition, the latticed base can also save materials and reduce the costs to an extent. A polyethylene material has a good flexibility, wear resistance, and weather resistance. The flexibility enables the grass yarns to bend and be not easily broken when a pet tramples on the turf or under another external force, to provide a comfortable tactile experience for the pet. The wear resistance ensures that the grass yarns will not be damaged due to frequent friction during long-term use, thereby prolonging the service life of the artificial turf. The weather resistance enables the grass yarns to adapt to different climatic conditions, such as exposure to sunlight and wind and rain erosion, and does not easily fade or deform. The KDK curved yarn process endows the grass yarns with a special curved shape that is closer to the form of natural grass. The grass yarns not only look more beautiful and natural, but also provide a better buffering effect during use, thereby lowering the risk of injury to the pet in an activity.

BRIEF DESCRIPTION OF DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work. In addition, the accompanying drawings are not drawn to a scale of 1:1, and the relative dimensions of the various elements are only shown as examples in the diagrams, not necessarily drawn to a true scale.

The present invention is further described below in detail in combination with the accompanying drawings and embodiments.

DETAILED DESCRIPTION OF THE INVENTION

Figure 1:
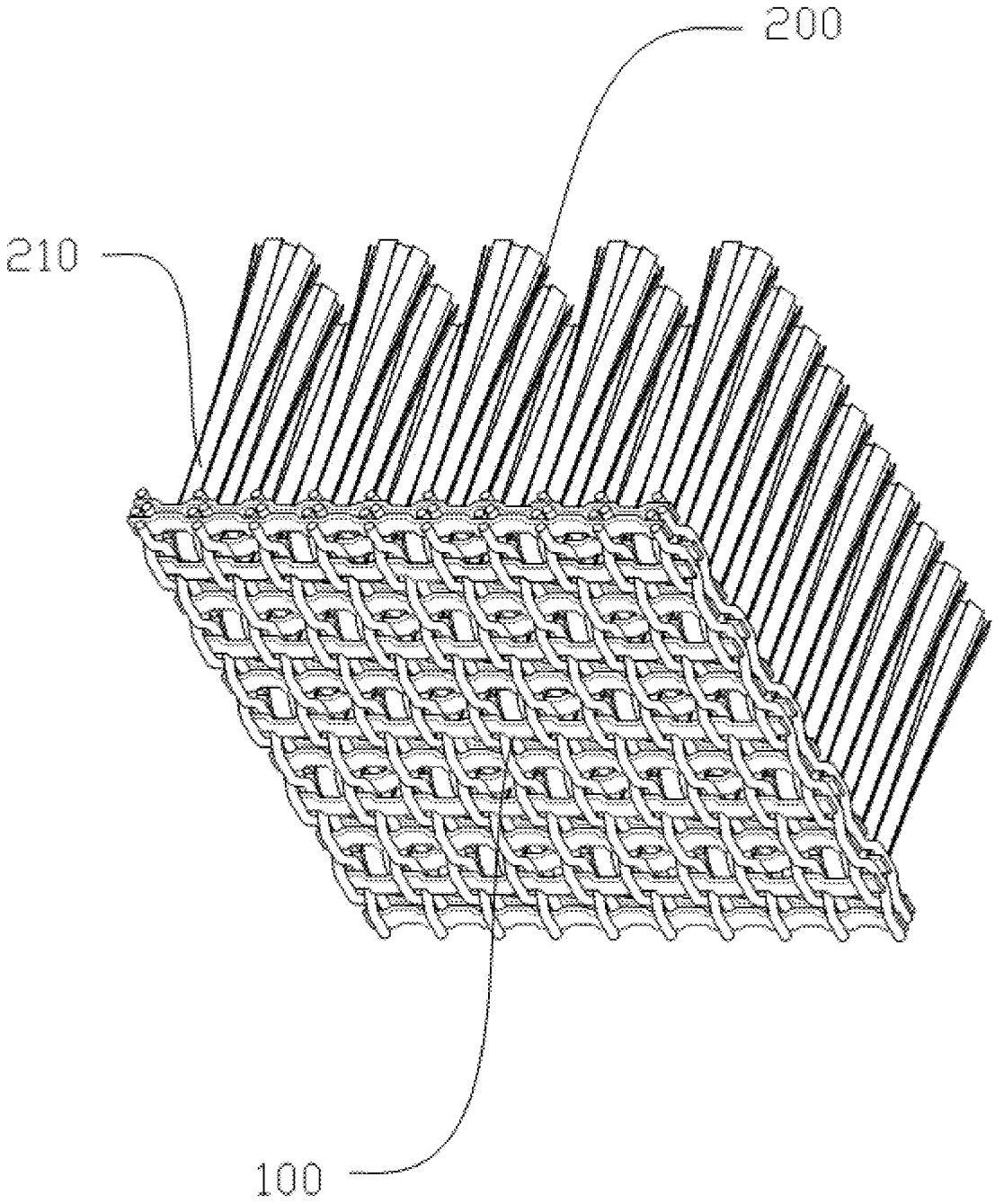
FIG. 1 is a schematic diagram of an entire structure of an artificial turf according to the present invention.

To make the aforementioned objectives, features, and advantages of the present invention more comprehensible, specific implementations of the present invention are described in detail below in conjunction with the accompanying drawings. In the following description, numerous specific details are set forth to provide a thorough understanding of the present invention. The present invention may, however, be embodied in many forms different from that described here. A person skilled in the art can make similar improvements without departing from the connotation of the present invention. Therefore, the present invention is not limited by the specific embodiments disclosed below.

In the description of the present invention, It is to be understood that, The terms "center", "longitudinal", "transverse", "upper", "lower", "front", "rear", "left", "right", "vertical", "horizontal", "top", "bottom", "inner", "outer", "clockwise", "counterclockwise", and the like indicate azimuth or positional relationships based on the azimuth or positional relationships shown in the drawings, For purposes of convenience only of describing the present invention and simplifying the description, Rather than indicating or implying that the indicated device or element must have a particular orientation, be constructed and operated in a particular orientation, therefore, not to be construed as limiting the present invention.

In addition, the terms "first" and "second" are used for descriptive purposes only, while not to be construed as indicating or implying relative importance or implicitly specifying the number of technical features indicated thereby, features defining "first," "second," and "second" may explicitly or implicitly include one or more of the described features. In the description of the present invention, "multiple" means two or more unless explicitly specified otherwise.

In addition, the terms "install", "arrange", "provide", "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For ordinary technical personnel in this field, the specific meanings of the above terms in present invention can be understood based on specific circumstances.

In the present invention, unless specific regulation and limitation otherwise, the first feature "onto" or "under" the second feature may include the direct contact of the first feature and the second feature, or may include the contact of the first feature and the second feature through other features between them instead of direct contact. Moreover, the first feature "onto", "above" and "on" the second feature includes that the first feature is right above and obliquely above the second feature, or merely indicates that the horizontal height of the first feature is higher than the second feature. The first feature "under", "below" and "down" the second feature includes that the first feature is right above and obliquely above the second feature, or merely indicates that the horizontal height of the first feature is less than the second feature.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Figure 2:
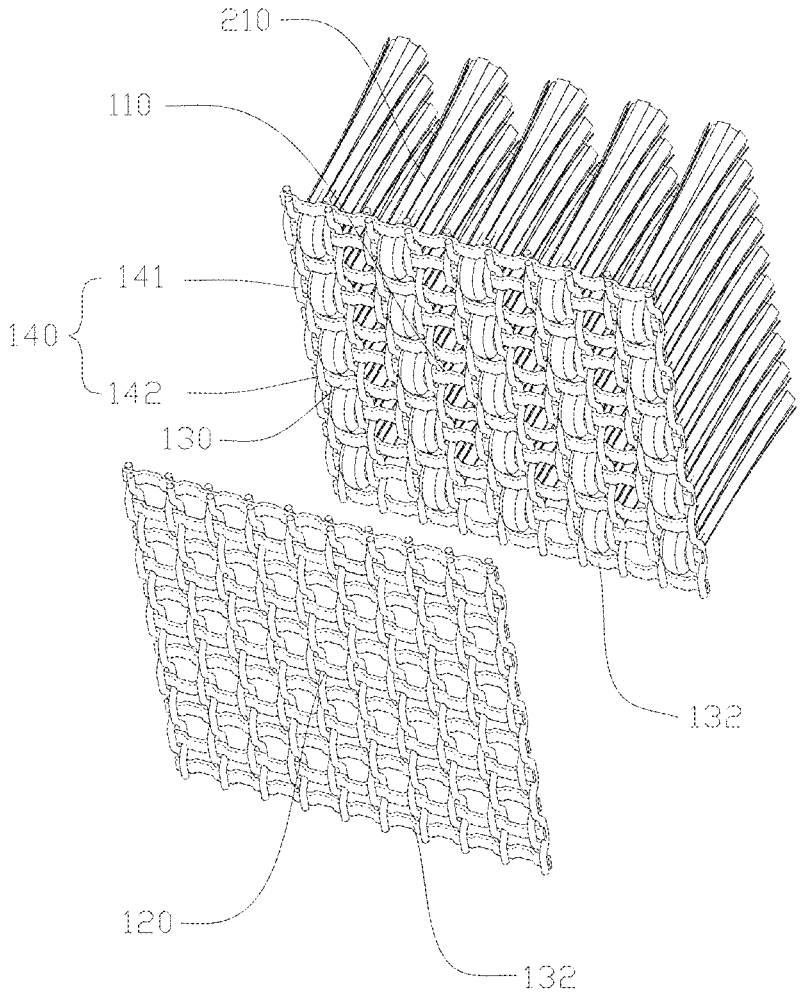
FIG. 2 is a schematic diagram of an exploded structure of an artificial turf in a first view according to the present invention.
Figure 3:
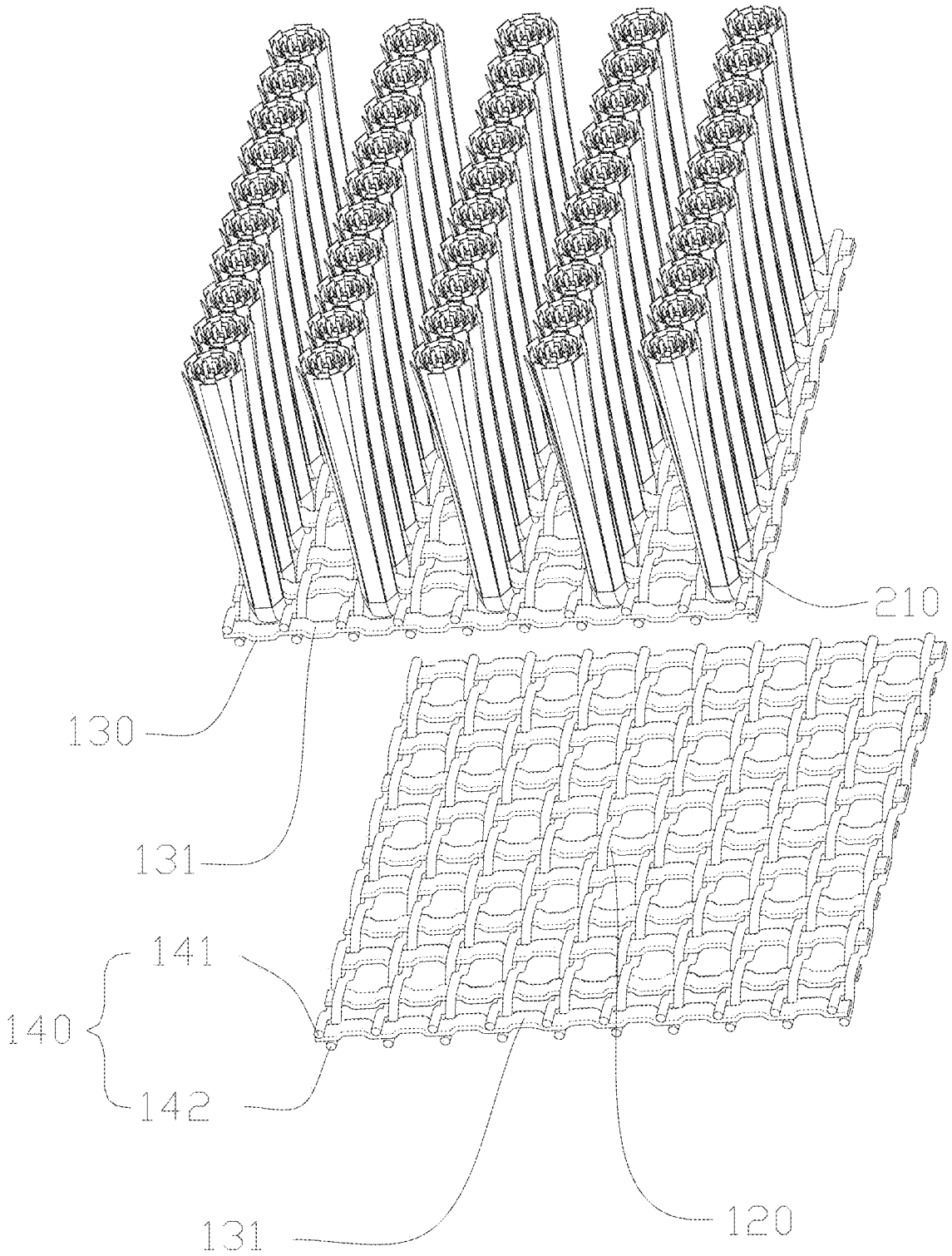
FIG. 3 is a schematic diagram of an exploded structure of an artificial turf in a second view according to the present invention.
Figure 4:
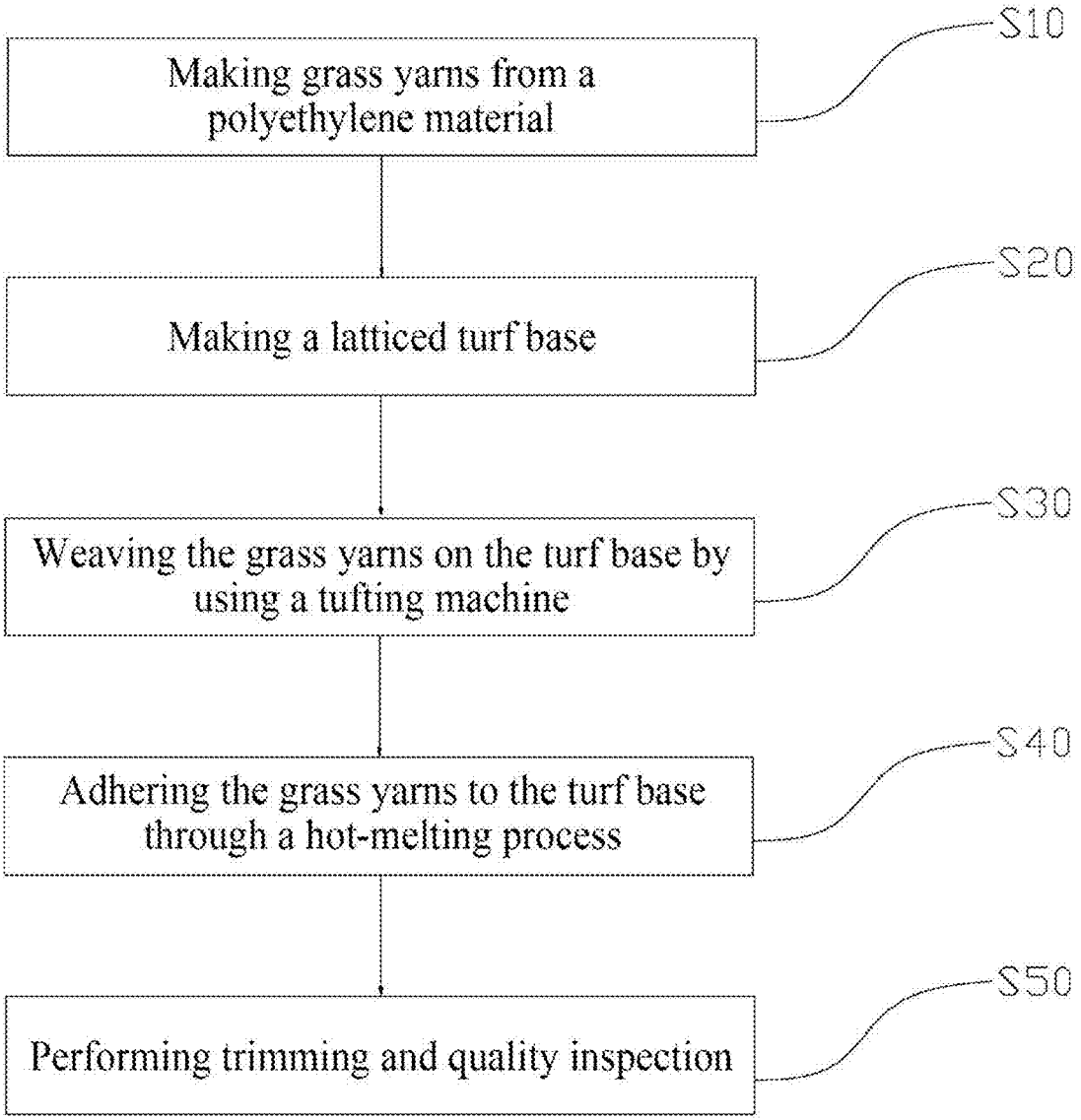
FIG. 4 is a flowchart of overall steps of a method according to the present invention.
Figure 5:
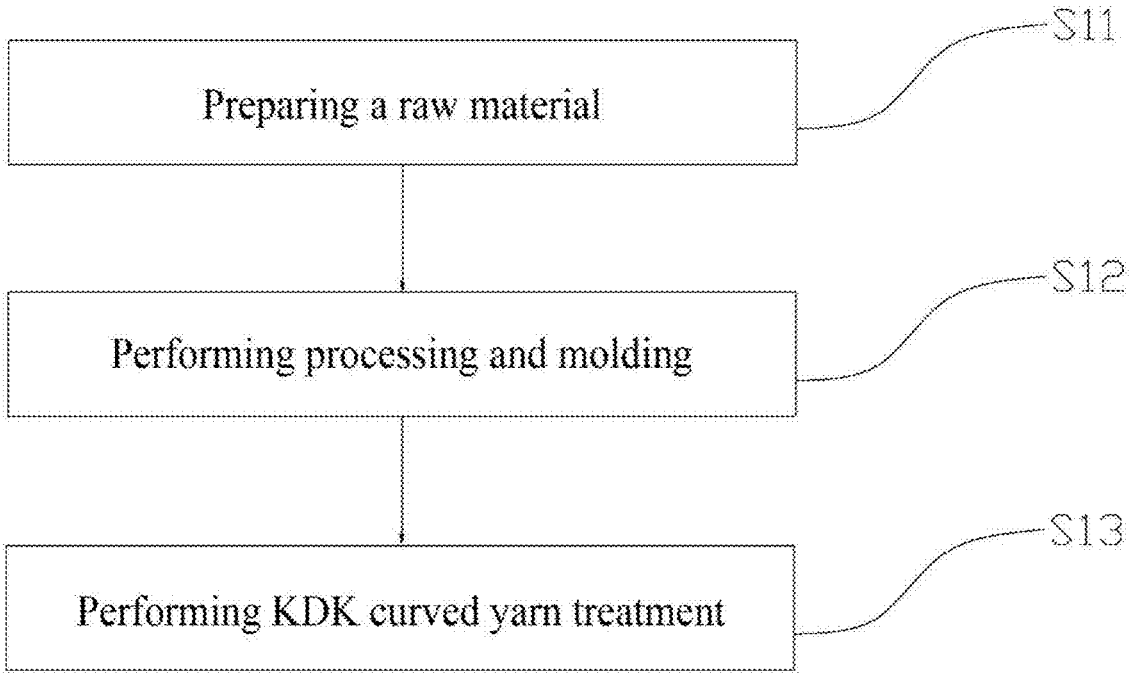
FIG. 5 is a detailed flowchart of step S10 of the method according to the present invention.
Figure 6:
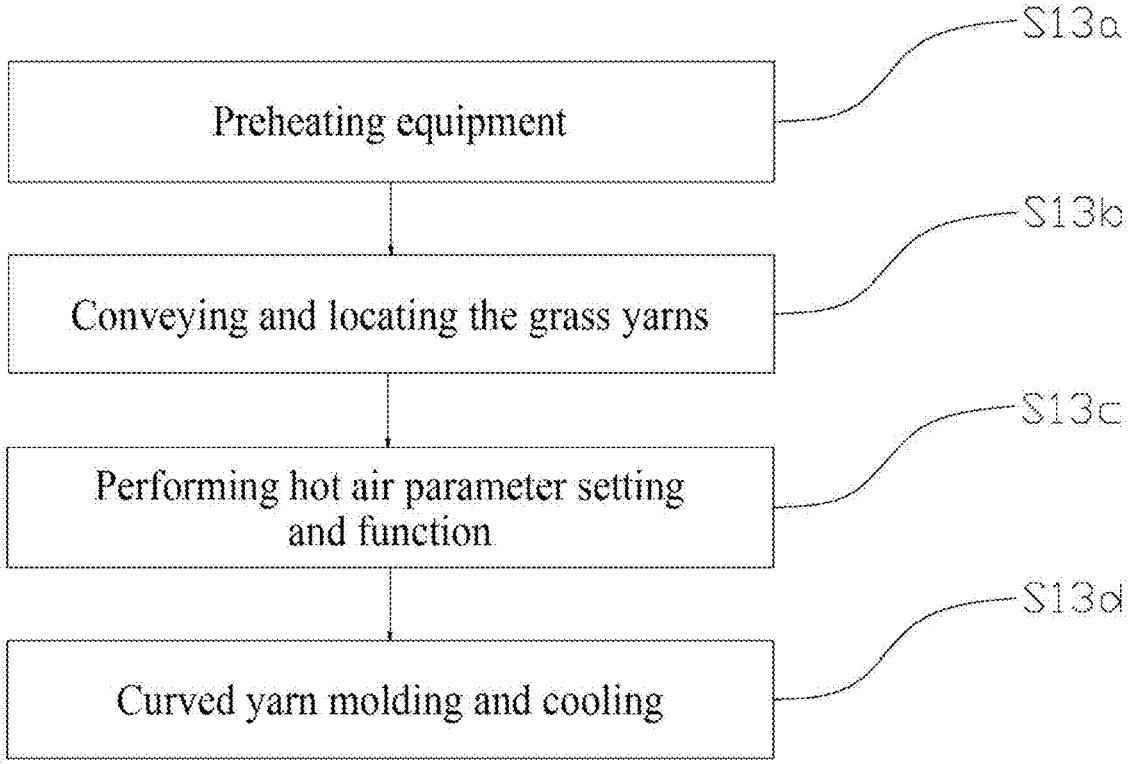
FIG. 6 is a detailed flowchart of step S13 of the method according to the present invention.
Figure 7:
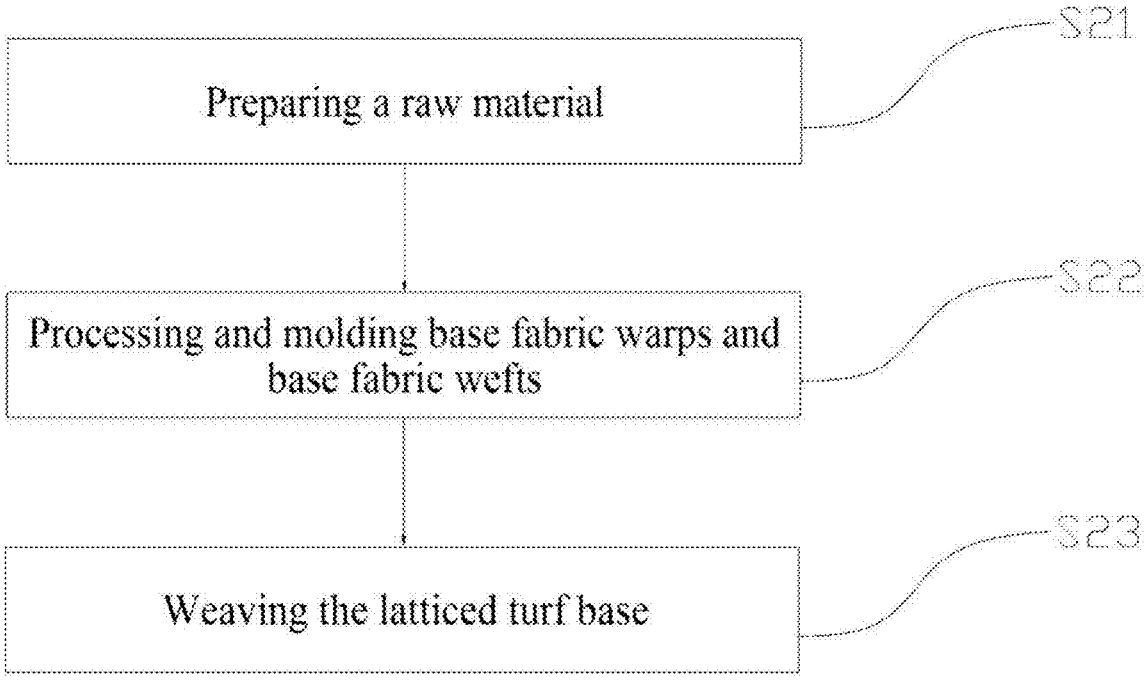
FIG. 7 is a detailed flowchart of step S20 of the method according to the present invention.
Figure 8:
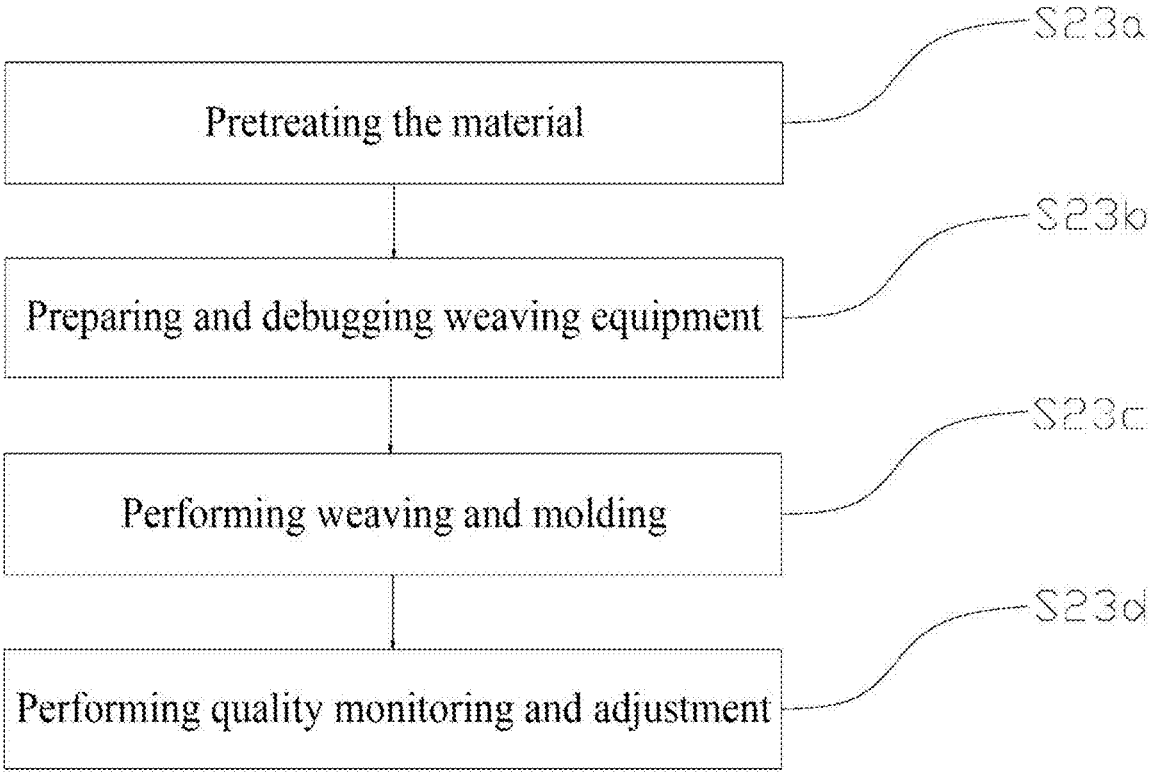
FIG. 8 is a detailed flowchart of step S23 of the method according to the present invention.
Figure 9:
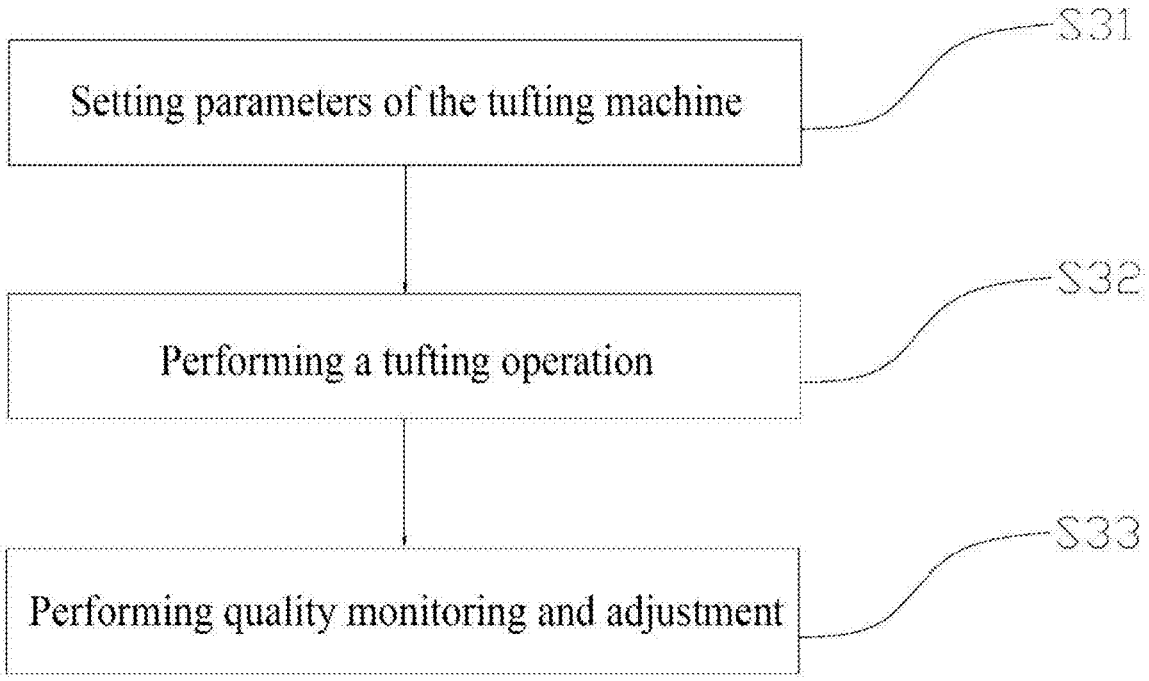
FIG. 9 is a detailed flowchart of step S30 of the method according to the present invention.
Figure 10:
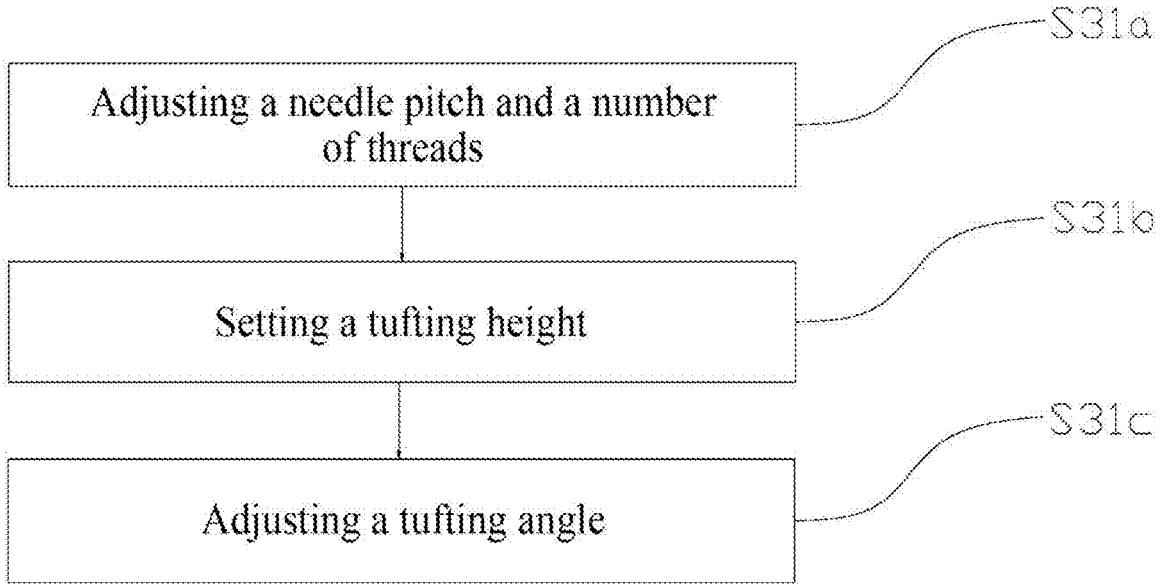
FIG. 10 is a detailed flowchart of step S31 of the method according to the present invention.
Figure 11:
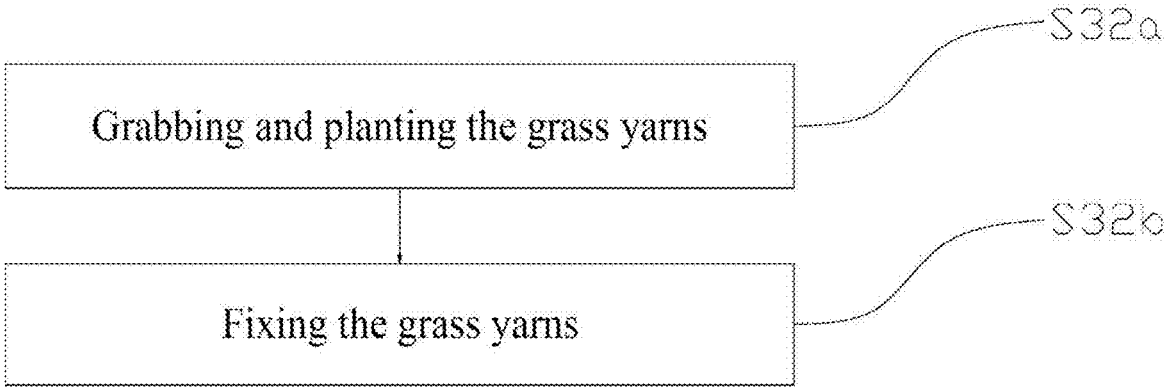
FIG. 11 is a detailed flowchart of step S32 of the method according to the present invention.
Figure 12:
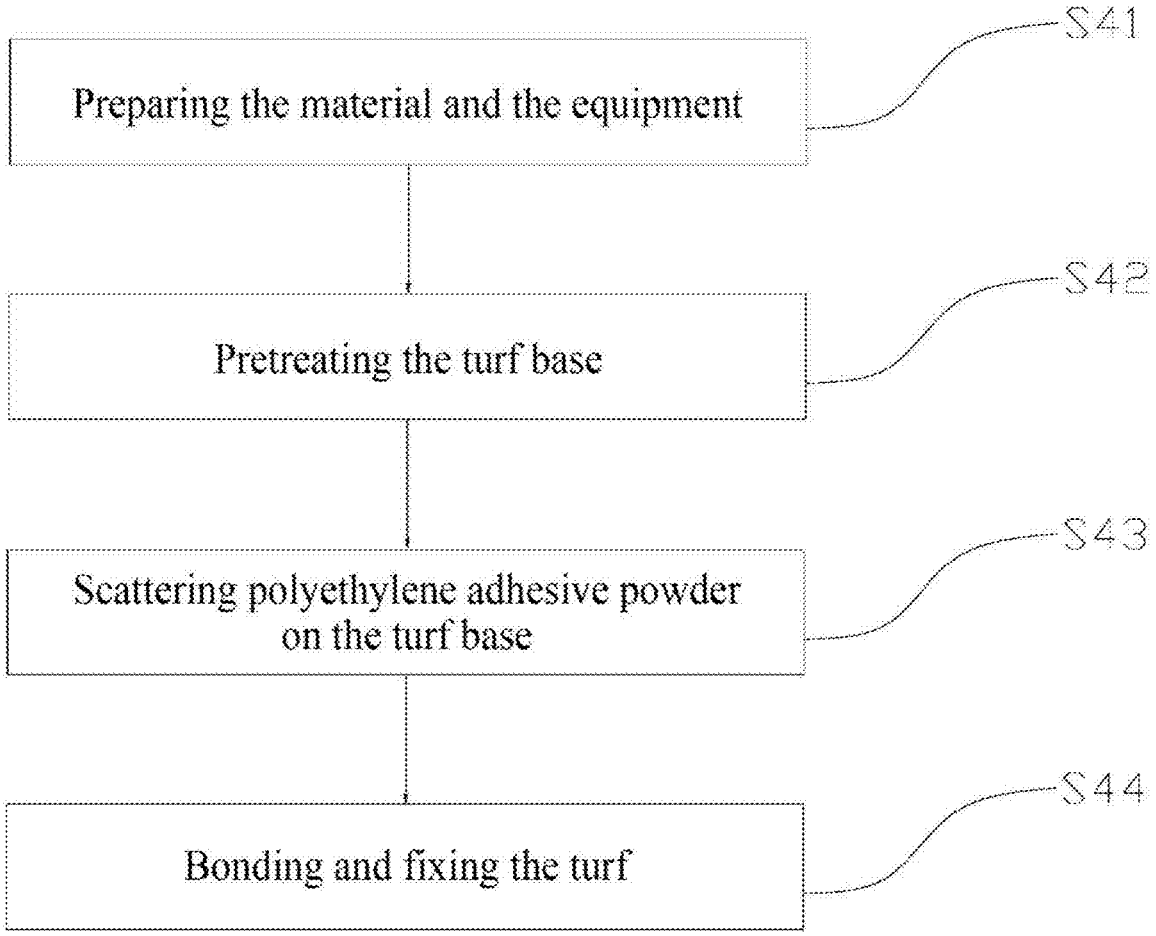
FIG. 12 is a detailed flowchart of step S40 of the method according to the present invention.
Figure 13:
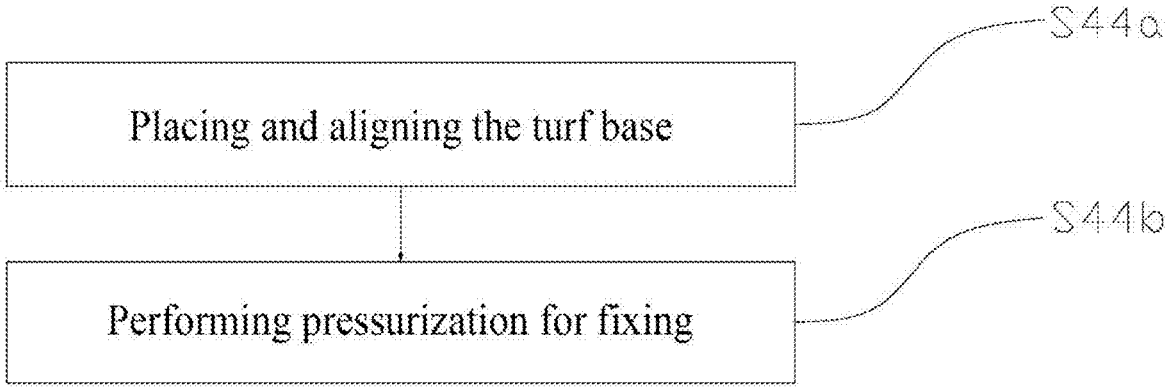
FIG. 13 is a detailed flowchart of step 44 of the method according to the present invention.

Referring to FIG. 1 to FIG. 13, the present invention discloses an artificial turf. The artificial turf includes a turf base 100 and a grass yarn portion 200. The turf base 100 is latticed. The grass yarn portion 200 is connected to the turf base 100 through thermoplastic adhesive powder. The grass yarn portion 200 includes grass yarn tufts 210. Each grass yarn tuft 210 includes a plurality of grass yarns. The grass yarns are prepared from a polyethylene through a KDK curved yarn process.

By the arrangement of the above structure, during use, the lattice design of the turf base 100 is conducive to water permeation, which enables water to quickly pass through the turf base 100, avoids water accumulation on a surface of the turf, and maintains a good use condition of the turf. Meanwhile, the latticed structure can provide a stable support for the grass yarn portion 200, ensuring that the grass yarns are not prone to lodging or displacement during long-term use. In addition, the latticed base can also save materials and reduce the costs to an extent. A polyethylene material has a good flexibility, wear resistance, and weather resistance. The flexibility enables the grass yarns to bend and be not easily broken when a pet tramples on the turf or under another external force, to provide a comfortable tactile experience for the pet. The wear resistance ensures that the grass yarns will not be damaged due to frequent friction during long-term use, thereby prolonging the service life of the artificial turf. The weather resistance enables the grass yarns to adapt to different climatic conditions, such as exposure to sunlight and wind and rain erosion, and does not easily fade or deform. The KDK curved yarn process endows the grass yarns with a special curved shape that is closer to the form of natural grass. The grass yarns not only look more beautiful and natural, but also provide a better buffering effect during use, thereby lowering the risk of injury to the pet in an activity.

In this embodiment, the turf base 100 includes a first base fabric 110 and a second base fabric 120; each of the first base fabric 110 and the second base fabric 120 includes base fabric warps 130 and base fabric wefts 140; and each of the first base fabric 110 and the second base fabric 120 is formed by vertically and horizontally weaving the base fabric warps 130 and the base fabric wefts 140 which are made of a thermoplastic resin material. By the arrangement of the above structure, during use, the two-layer structural design of the turf base 100 can provide a higher structural stability for the artificial turf compared with a single-layer base fabric. The latticed structure formed by warp and weft weaving provides a foundation for the water permeability and air permeability of the turf base 100. Water can smoothly pass through gaps between the warps and the wefts, and air can also be circulated in this latticed structure, which is beneficial for keeping the turf dry and clean. In a scenario that a pet uses the artificial turf, the good breathability and permeability help to quickly discharge liquid such as urine, thus reducing odors and bacteria breeding. Each of the first base fabric 110 and the second base fabric 120 is formed by vertically and horizontally weaving the base fabric warps 130 and the base fabric wefts 140 which are made of the thermoplastic resin material. This weaving mode makes the base fabrics have good integrity. The warps and the wefts are interwoven with each other, thus forming a tight latticed structure, and each intersection point plays a role of connection and fixing. It is just like cloth weaving. This structure can effectively distribute force across the entire base fabric plane, thus enhancing its ability to resist stretching and tearing of the external force.

In this embodiment, the thermoplastic resin material is polypropylene. In the scenario that the pet uses the artificial turf, various chemicals may be in contact with the grass base 100. For example, excrement of the pet contains chemical components. The polypropylene has a good chemical stability and has high resistance to these chemical substances, and its performance will not decrease due to chemical reactions with these substances. For example, urea and other components in the urine will not corrode the polypropylene turf base 100, thus ensuring that the performance of the turf base 100 is not affected and maintaining its normal water and air permeability and other functions.

In this embodiment, the grass yarns are arranged in a spacing manner along the base fabric warps 130 and are continuously arranged along the base fabric wefts 140. By the arrangement of the above structure, during use, the grass yarns are arranged in the spacing manner along the base fabric warps 130, which helps to form drainage channels. When water (such as rainwater or urine of a pet) falls on the turf, the water will flow along gaps between the grass yarns and along the base fabric warps 130. Due to loosened arrangement of the grass yarns, the water can more easily penetrate into the turf base 100 and be discharged through the latticed structure of the turf base 100, thereby improving the water permeability of the turf, effectively avoiding water accumulation on the surface of the turf, keeping the turf dry and clean, and reducing odors and bacteria breeding. The grass yarns are continuously arranged along the base fabric wefts 140, so that a relatively continuous barrier can be formed in this direction. The continuous grass yarns can play a role of blocking and guidance when the water flows on the surface of the turf. For example, on the inclined surface of the turf, when the water is drained along the base fabric warps 130, the continuous grass yarns along the base fabric wefts 140 can prevent excessive horizontal diffusion of the water, thus ensuring that the water can be smoothly discharged along a designed drainage path (mainly along the base fabric warps 130), and further improving the drainage efficiency.

In this embodiment, the base fabric warps 130 are flatly linear, and the base fabric warps 130 include front surfaces 131 of warp and back surfaces 132 of warp; the base fabric wefts 140 include first wefts 141 and second wefts 142; and the first wefts 141 and the second wefts 142 alternately abut against the front surfaces 131 of warp and the back surfaces 132 of warp during weaving. By the arrangement of the above structure, during use, the base fabric warps 130 are flatly linear. Compared with circular wires, the flat structure can provide a larger contact area in a width direction. Under an external force, such as pressure and friction generated by a pet moving on the artificial turf, the flat warps can better disperse the force. The gaps between the flatly linear warps serve as channels during drainage and ventilation, and their shapes may affect flowing of water and air. Compared with circular gaps between the circular wires, the gaps between the flat warps may form channels that are more favorable for quick passing of water and air, thereby helping to improve the water and air permeability of the turf base 100. The first wefts 141 and the second wefts 142 alternately abut against the front surfaces 131 of warp and the back surfaces 132 of warp during weaving. By this weaving mode, a mutually interwoven and tightly wound structure is formed. Each weft has a plurality of intersection points with the warps. In addition, due to the front and back alternate weaving, the distribution of these intersection points is more uniform, thereby greatly improving the stability of the woven structure. Like a woven rope, this complex and orderly interwoven structure can effectively resist pulling and twisting by an external force, ensuring that the turf base 100 can maintain its shape and structural integrity under various complex stress conditions (such as scratching, digging, etc. of a pet).

In this embodiment, a grid of the turf base 100 is a polygon, and an edge length of the polygon is greater than 1 mm. By the arrangement of the above structure, during use, the grid of the turf base 100 is the polygon with the edge length greater than 1 mm, which means that relatively large pores are formed between the grids. When water (such as rainwater and urine of a pet) falls onto the turf, the large pores can allow the water to penetrate more quickly through the turf base. Compared with a structure in which each grid has a small edge length, the water in these large pores undergoes less resistance and can flow more smoothly downwards, thereby greatly increasing the drainage speed of the turf and reducing a possibility of water accumulation on the surface of the turf. This is beneficial for keeping the surface of the turf dry and reducing bacteria breeding.

In this embodiment, a grid of the turf base 100 is approximately a square, and an edge length of the square is about 3 mm. By the arrangement of the above structure, during use, square grids have regularity, and the drainage abilities in all directions are balanced. The water can uniformly penetrate downwards through these square grids no matter the water falls on the turf in which angle, thus avoiding a problem of local drainage obstruction or water accumulation that may occur due to irregular grid shapes, and ensuring the consistency of the drainage performance of the entire turf. Compared with grids having a smaller size, the square pores with the edge length of 3 mm provide smoother channels for water, thus reducing the water flowing resistance and helping to improve the drainage speed. This effectively avoids the water accumulation on the surface of the turf, which ensures that the turf remains dry in a scenario that a pet does activities frequently.

In this embodiment, the thermoplastic adhesive powder is polyethylene adhesive powder. By selecting the above adhesive powder, the artificial turf no longer relies on styrene butadiene latex. The overall material of the turf is a mixture of polypropylene and polyethylene which are easily recycled plastic materials.

In this embodiment, the grass yarns are woven on the turf base 100 through a tufting process, and are then adhered to the turf base 100 through a hot-melting process. In the tufting process, the grass yarns are woven on the turf base 100 by operating a tufting machine, to preliminarily fix the grass yarns and provide a relatively stable position for the grass yarns on the turf base 100. This provides a good foundation for the subsequent hot-melting process. The hot-melting process further enhances the connection between the grass yarns and the turf base 100 based on tufting. The grass yarns and the thermoplastic adhesive powder for bonding are molten by heating, and are then cooled and solidified, so that strong bonding is formed between the grass yarns and the turf base, thereby reducing the possibility that the grass yarns fall off, improving the durability of the artificial turf, and enhancing the user experience.

In this embodiment, a water permeability at 200 ml/20 s of the artificial turf is 65% to 75%, and a water permeability at 200 ml/20 s of an ordinary artificial turf is about 15%. The water permeability of the artificial turf of the present invention is 4 to 5 times that of the ordinary turf. Thanks to its excellent water permeability, the breathability is also very outstanding. In a ventilation environment, the odor of the urine of a pet can be eliminated within short time.

The present invention further discloses a making method of an artificial turf, including:

S10: making grass yarns from a polyethylene material;

S20: making a latticed turf base;

S30: weaving the grass yarns on the turf base by using a tufting machine;

S40: adhering the grass yarns to the turf base through a hot-melting process; and S50: performing trimming and quality inspection.

Through the settings of the above steps, during execution, in step S10, the polyethylene material is selected. Compared with a traditional mixture of polyethylene and polypropylene, the polyethylene material has better softness and is more comfortable in tactile sense, and a pet feels gentle when touching the turf. In step S20, the latticed turf base provides clear locating and attachment points for plantation of the grass yarns. The grass yarns can be orderly tufted and fixed according to a grid pattern, making it easier for an operator to control a planting density and arrangement of the grass yarns, thereby improving the production efficiency. Meanwhile, this can further ensure the uniformity and reasonability of distribution of the grass yarns on the base, and improve the overall quality of the artificial turf. In step S30, operating the tufting machine achieves initial combination between the grass yarns and the turf base, so that the grass yarns have relatively stable positions on the base. In step S40, the hot-melting process is a key step in enhancing the connection strength for the grass yarns and the turf base. The grass yarns and the thermoplastic material for bonding are melted by heating, and are then tightly bonded under a pressure. After cooling, the grass yarns and the thermoplastic material are firmly bonded. This enhanced connection can bear a greater external force. Even in a situation of a high tension and frictional force generated because a pet frequently moves or plays around on the turf, it is very difficult for the grass yarns to fall off from the turf base, which greatly improves the durability and structural stability of the artificial turf and prolongs the service life of the artificial turf. In step S50, the appearance quality of the turf can be enhanced, and ensure that the aesthetic degree of the product meets a requirement.

In this embodiment, step S10 includes:

S11: preparing a raw material;

S12: performing processing and molding; and

S13: performing KDK curved yarn treatment.

Through the setting of the above steps, during execution, in step S11, it is crucial to accurately select a suitable polyethylene raw material, as factors such as the purity and particle size of the raw material may have a significant impact on subsequent processing and molding steps. The polyethylene raw material with high purity can ensure the stability and consistency of the performance of the grass yarns. If there are impurities in the raw material, it may affect the quality of the grass yarns during the processing, such as causing bubbles and non-uniform strength in the grass yarns. With an appropriate particle size, the raw material can be uniformly heated and uniformly flow in processing equipment, thus ensuring the molding quality of the grass yarns. In step S12, by using an extrusion process, the principle is heating the polyethylene raw material to a molten state in a heating device, and then extruding the raw material into yarns through a mold with a specific shape. In step S13, using KDK curved yarns is to endow the grass yarns a more natural curved shape, making the yarns have an appearance closer to the appearance of the natural grass. Through this treatment, the grass yarns can present a natural curled effect on the artificial turf, which enhances the simulation of the turf. Visually, this curved grass yarn can create a more vivid and realistic grassland landscape, which can enhance the visual user experience whether the turf is used for landscape beautification or used as an activity place for a pet.

In this embodiment, step S13 includes:

S13*a*: preheating equipment;

S13*b*: conveying and locating the grass yarns;

S13*c*: performing hot air parameter setting and function; and

S13*d*: curved yarn molding and cooling.

By the setting of the above steps, step S13*a* is a start of curved yarn treatment. By preheating relevant equipment to make the equipment reach an appropriate working temperature, a stable processing environment is created for subsequent yarn treatment, thus ensuring smooth execution of the entire curved yarn process and avoiding the impact of unsuitable equipment temperature on a grass yarn molding effect. Step S13*b* is responsible for accurately conveying the processed and molded grass yarns to a designated position, to ensure that the grass yarns are in an appropriate spatial position for precise use of hot air in the future. It is an important basis for achieving uniform and accurate bending of the grass yarns, and is related to the consistency of the quality of the curved yarns. In step S13*c* and step S13*d*, hot air parameters are set first; hot air is used to act on the fixed grass yarns, to heat the grass yarns to a bendable state. Then, under the action of heat, the curved yarns are molded and are then cooled, to fix the shapes of the grass yarns. The two steps work closely together to ultimately give the grass yarns a natural curved shape, thus improving the aesthetic degree and usability of the artificial turf.

In this embodiment, step S20 includes:

S21: preparing a raw material;

S22: processing and molding base fabric warps and base fabric wefts; and

S23: weaving the latticed turf base.

Through the setting of the above steps, during execution, step S21 is a primary step of making the latticed turf base. The selection of the raw material has a fundamental impact on the performance of the turf base. In this embodiment, polypropylene is selected as the raw material for making the latticed turf base. In step S22, a specific processing technique is used to make the raw material into base fabric warps and base fabric wefts. During the processing, a size, a shape, and physical properties need to be precisely controlled, to ensure uniform interweaving during weaving, thus forming a stable-quality and structurally regular turf base, which lays a solid foundation for the subsequent weaving step. In step S13, the latticed structure is formed through the weaving process, so that the turf base has a good stability and maintains its shape under both a vertical pressure and a horizontal tension. By careful weaving, the turf base becomes a structural unit that can effectively drain water and firmly support the grass yarns.

In this embodiment, step S23 includes:

S23*a*: pretreating the material;

S23*b*: preparing and debugging weaving equipment;

S23*c*: performing weaving and molding; and

S23*d*: performing quality monitoring and adjustment.

By the setting of the above steps, during execution, in step S23, the pretreatment of the material in S23*a* ensures that the material for weaving has stable properties and impurities are removed, which lays a solid foundation for subsequent procedures. In S23*b*, the weaving equipment is prepared and debugged to achieve an optimal operation state, thus ensuring smooth weaving. The weaving and molding procedures in S23*c* form a product structure according to a predetermined process, and the quality monitoring and adjustment procedures in S23*d* are performed to inspect and correct errors in real time, to ensure that the quality of a final product meets a standard.

In this embodiment, step S30 includes:

S31: setting parameters of the tufting machine;

S32: performing a tufting operation; and

S33: performing quality monitoring and adjustment.

By the setting of the above steps, during execution, in step S30, setting the parameters of the tufting machine in S31 determines key indicators such as a density, depth, and spacing of grass yarn plantation and provides an important prerequisite for precise implementation of the tufting operations. By the tufting operation in S32, the grass yarns are woven on the turf base in an orderly manner on according to the set parameters, thus preliminarily constructing an overall form of the artificial turf. In S33, the quality monitoring and adjustment are carried out throughout the tufting process. By testing and correcting errors of grass yarn plantation in real time, it ensures that the tufting effect meets a quality requirement and guarantees the quality and performance of the final artificial turf product.

In this embodiment, step S31 includes:

S31*a*: adjusting a needle pitch and a number of threads;

S31*b*: setting a tufting height; and

S31*c*: adjusting a tufting angle.

By the setting of the above steps, during execution, in S31*a*, adjusting the needle pitch and the number of threads is used for controlling a distribution density of the grass yarns on the turf base. The proper matching between the needle spacing and the number of threading can ensure that the grass yarns are neither too sparse nor too dense, as the density may affect the appearance and tactile sense of the turf. In S31*b*, setting the tufting height determines depths at which the grass yarns are planted into the turf base. An appropriate height ensures that the grass yarns are firmly fixed on the turf base and avoids damage to the structure of the turf base. Secondly, in S31*c*, adjusting the tufting angle can enable the grass yarns to be planted at a more suitable angle into the turf base, which not only affects an arrangement direction and overall aesthetic degree of the grass yarns, but also is related to a direction of an external force that the grass yarns can bear during subsequent use. By adjusting these parameters, the tufting effect on the grass yarns can be optimized.

In this embodiment, step S32 includes:

S32*a*: grabbing and planting the grass yarns; and

S32*b*: fixing the grass yarns.

By the setting of the above steps, during execution, in S32*a*, the operation of grabbing and planting the grass yarns is used to place the grass yarns at corresponding positions on the turf base 100 according to the set parameters. Then, with the help of S32*b* of fixing the grass yarns, the grass yarns are firmly fixed on the base to complete the preliminary bonding procedure of the grass yarns on the turf base 100.

In this embodiment, step S40 includes:

S41: preparing the material and the equipment;

S42: pretreating the turf base;

S43: scattering polyethylene adhesive powder on the turf base; and

S44: bonding and fixing the turf.

By the setting of the above steps, during execution, in step S40, preparing the material and the equipment in S41 provides a basic support for the subsequent procedures, thus ensuring that the material for bonding and the related equipment is complete and operate normally. In S42, the turf base 100 is pretreated, which can effectively clean and optimize a surface of the base, facilitate better adhesion of the adhesive powder, and enhance the bonding effect. In S43, the polyethylene adhesive powder is scattered on the turf base 100 to provide a key medium for bonding. The bonding and fixation of the turf in S44 are achieved through appropriate technical means. By using the adhesive powder, the grass yarns and the turf base 100 are firmly bonded, which improves the overall stability and durability of the artificial turf.

In this embodiment, step S44 includes:

S44*a*: placing and aligning the turf base; and

S44*b*: performing pressurization for fixing.

By the setting of the above steps, during execution, the turf base 100 is first placed and aligned in S44*a*, to ensure that each part is in a correct position. Then, by pressurization for fixing in S44*b*, the grass yarns are tightly adhered to the turf base 100 using an appropriate pressure to achieve a firm bonding effect.

As described above, one or more embodiments are provided in conjunction with the detailed description, The specific implementation of the present invention is not confirmed to be limited to that the description is similar to or similar to the method, the structure and the like of the present invention, or a plurality of technical deductions or substitutions are made on the premise of the conception of the present invention to be regarded as the protection of the present invention.

The invention claimed is:

1. An artificial turf, comprising:

a turf base, wherein the turf base is latticed; and a grass yarn portion, wherein the grass yarn portion is connected to the turf base through thermoplastic adhesive powder; the grass yarn portion comprises grass yarn tufts; each grass yarn tuft comprises a plurality of grass yarns; and the grass yarns are prepared from a polyethylene through a KDK curved yarn process to form a curved shape;

wherein the turf base comprises a first base fabric and a second base fabric, each of the first base fabric and the second base fabric comprises base fabric warps and base fabric wefts made of a thermoplastic resin material, each of the first base fabric and the second base fabric is formed by vertically and horizontally weaving the base fabric warps and the base fabric wefts with gaps formed between the base fabric warps and the base fabric wefts; and wherein a middle portion of each of the grass yarns extends through two adjacent gaps along the base fabric wefts of the first base fabric, the grass yarns are arranged in a spacing manner along the base fabric warps and are continuously arranged along the base fabric wefts in a manner that two adjacent grass yarns along the base fabric wefts are spaced by one of the base fabric warps, two adjacent grass yarns along the base fabric warps are spaced by two adjacent base fabric wefts and two adjacent gaps along the two adjacent base fabric wefts, and the two adjacent gaps are remained blank; and the first base fabric and the second base fabric are aligned in a manner that the base fabric warps of the first base fabric are aligned with the base fabric warps of the second base fabric, the base fabric wefts of the first base fabric are aligned with the base fabric wefts of the second base fabric, and the gas of the first base fabric are aligned with the gaps of second base fabric.

2. The artificial turf according to claim 1, wherein the thermoplastic resin material is polypropylene.

3. The artificial turf according to claim 1, wherein the base fabric warps are flatly linear, and the base fabric warps comprise front surfaces of warp and back surfaces of warp; the base fabric wefts comprise first wefts and second wefts; and the first wefts and the second wefts alternately abut against the front surfaces of warp and the back surfaces of warp during weaving.

4. The artificial turf according to claim 1, wherein a grid of the turf base is a polygon, and an edge length of the polygon is greater than 1 mm.

5. The artificial turf according to claim 1, wherein a grid of the turf base is approximately a square, and an edge length of the square is about 3 mm.

6. The artificial turf according to claim 1, wherein the thermoplastic adhesive powder is polyethylene adhesive powder.

7. The artificial turf according to claim 5, wherein the grass yarns are woven on the turf base through a tufting process, and are then adhered to the turf base through a hot-melting process.

8. The artificial turf according to claim 1, wherein a water permeability at 200 ml/20 s of the artificial turf is 65% to 75%.

9. An artificial turf for pets, comprising:

a turf base, wherein the turf base is latticed; and a grass yarn portion, wherein the grass yarn portion is connected to the turf base through thermoplastic adhesive powder; the grass yarn portion comprises grass yarn tufts; each grass yarn tuft comprises a plurality of grass yarns;

the turf base comprises a first base fabric and a second base fabric, each of the first base fabric and the second base fabric comprises base fabric warps and base fabric wefts, each of the first base fabric and the second base fabric is formed by vertically and horizontally weaving the base fabric warps and the base fabric wefts with gaps formed between the base fabric warps and the base fabric wefts;

wherein a middle portion of each of the grass yarns extends through two adjacent gaps along the base fabric wefts of the first base fabric, the grass yarns are arranged in a spacing manner along the base fabric warps and are continuously arranged along the base fabric wefts in a manner that two adjacent grass yarns along the base fabric wefts are spaced by one of the base fabric warps, two adjacent grass yarns along the base fabric warps are spaced by two adjacent base fabric wefts and two adjacent gaps along the two adjacent base fabric wefts, and the two adjacent gaps are remained blank; and the first base fabric and the second base fabric are aligned in a manner that the base fabric warps of the first base fabric are aligned with the base fabric warps of the second base fabric, the base fabric wefts of the first base fabric are aligned with the base fabric wefts of the second base fabric, and the gas of the first base fabric are aligned with the gaps of second base fabric.

* * * * *